US005745929A

United States Patent [19]

Sobieralski

[11] Patent Number: 5,745,929

[45] Date of Patent: May 5, 1998

[54] SANITARY COVERING METHOD AND APPARATUS

[76] Inventor: Linda Paula Sobieralski, 35 Burtis Ave., Yonkers, N.Y. 10701

[21] Appl. No.: 763,165

[22] Filed: Dec. 10, 1996

Related U.S. Application Data

[62] Division of Ser. No. 531,112, Sep. 20, 1995, abandoned.

[51] Int. Cl.[6] ..... A47K 13/14

[52] U.S. Cl. ..... 4/245.1; 4/245.5; 383/67; 383/75; 383/207; 383/209

[58] Field of Search ..... 4/245.1–245.9, 4/243.1, 243.2, 661, 452; 383/67, 75, 207, 209; 150/154, 165; 2/69.5, 84, 87

[56] References Cited

U.S. PATENT DOCUMENTS

| | | | |
|---|---|---|---|
| Re. 32,807 | 12/1988 | Adams | 4/235 |
| D. 346,206 | 4/1994 | Crossley et al. | D23/296 |
| 1,194,972 | 8/1916 | Dunn . | |
| 1,304,511 | 5/1919 | Quackenbush | 4/245.3 |
| 1,402,307 | 1/1922 | Metcalf | 4/245.3 |
| 1,522,699 | 1/1925 | Reid | 4/245.8 |
| 1,582,527 | 4/1926 | Marks | 4/245.3 |
| 1,595,558 | 10/1926 | Mayhew | 150/154 X |
| 1,966,950 | 4/1934 | Brooke | 4/245.3 |
| 2,169,834 | 8/1939 | Englert | 4/245.4 X |
| 2,332,658 | 10/1943 | Muller | 4/239 |
| 2,518,272 | 8/1950 | Beckwith | 4/239 |
| 2,637,360 | 5/1953 | Doebler | 4/661 |
| 2,676,331 | 4/1954 | Inman | 4/239 |
| 2,716,244 | 8/1955 | Wendel | 4/239 |
| 2,741,287 | 4/1956 | Michaud | 4/661 |
| 2,820,969 | 4/1958 | Wedge | 4/239 |
| 2,825,070 | 4/1958 | Alexander et al. | 4/239 |
| 3,340,546 | 9/1967 | Moore et al. | 4/239 |
| 3,371,356 | 3/1968 | Benjamin | 4/239 |
| 4,516,279 | 5/1985 | Block | 4/235 |
| 4,783,856 | 11/1988 | Bouwens et al. | 2/87 |
| 4,920,584 | 5/1990 | Abdrabbo | 4/245.7 X |
| 5,067,185 | 11/1991 | Kohler | 4/245.1 X |
| 5,213,141 | 5/1993 | Dorman | 383/75 X |
| 5,305,907 | 4/1994 | Richardson et al. | 150/154 X |
| 5,490,623 | 2/1996 | McConnell | 383/38 X |

OTHER PUBLICATIONS

Miles Kimball Catalogue, See "Toilet Seat Covers", p. 41.

*Primary Examiner*—Charles E. Phillips
*Attorney, Agent, or Firm*—Walter J. Tencza, Jr.

[57] ABSTRACT

A sanitary cover comprised of a non-porous flexible material having a first opening is provided. The flexible material can be large enough to cover a toilet seat, and to tuck one or more portions of the flexible material underneath the toilet seat, to secure the toilet seat cover. The flexible material may be in the shape of a sheet or a bag. A bag shaped flexible material has a top opening which is large enough to fit over the toilet seat and to tuck one or more portions underneath the toilet seat. There is also provided a bottom opening in the bag shape which is preferably ovally shaped and slightly smaller than the opening in the toilet seat. An attachment device is provided through which a cord passes. The cord may be elastic or plastic and can be pulled to tighten and further secure the top of the bag shape underneath the toilet seat.

5 Claims, 2 Drawing Sheets

SANITARY COVERING METHOD AND APPARATUS

This is a divisional of application Ser. No. 08/531,112 filed on Sep. 20, 1995, now abandoned.

FIELD OF THE INVENTION

This invention relates to the field of sanitary covers and more particularly to toilet seat covers.

BACKGROUND OF THE INVENTION

Toilet seat covers, such as used in public restrooms, are typically paper tissues. These covers are just large enough to cover the toilet seat. The paper composition of these covers, as well as their size and their shape, provide inadequate protection against transmission of disease. The tissue paper is porous and flimsy, allowing liquids to seep through to the skin and easily tearing.

Rigid toilet seat covers, such as those which reduce the size of the toilet seat for children, are known in various forms in the art. These rigid covers are typically not disposable and are cumbersome to construct and/or to carry.

SUMMARY OF THE INVENTION

The present invention in one embodiment comprises a sanitary cover comprised of a flexible material having a first opening. The flexible material is preferably non-porous and is large enough to cover a toilet seat, and to tuck one or more portions of the flexible material underneath the toilet seat, to secure the toilet seat cover. The first opening is typically slightly smaller than the opening in the toilet seat.

The flexible material may be in the shape of a sheet or a bag. A bag shaped flexible material preferably has a top opening which is large enough to fit over the toilet seat and to tuck one or more portions underneath the toilet seat. There is typically also provided a bottom opening in the bag shape which is preferably ovally shaped and slightly smaller than the opening in the toilet seat.

In one embodiment of the invention an attachment device is provided at one or more locations around a peripheral portion of the bag shape. In this embodiment a cord passes through the attachment device. The cord can be pulled to tighten and further secure the bag shaped toilet seat cover underneath the toilet seat. The cord may be, for example, elastic or plastic.

The present invention in one embodiment also includes a method comprising the steps of placing a material having an opening over a toilet seat; and tucking one or more portions of the material under the toilet seat. This material may be bag shaped and the method for securing the material may include pulling a cord which is attached and substantially surrounds a peripheral area of the bag shaped material.

DETAILED DESCRIPTION OF THE DRAWINGS

Figure 1A:
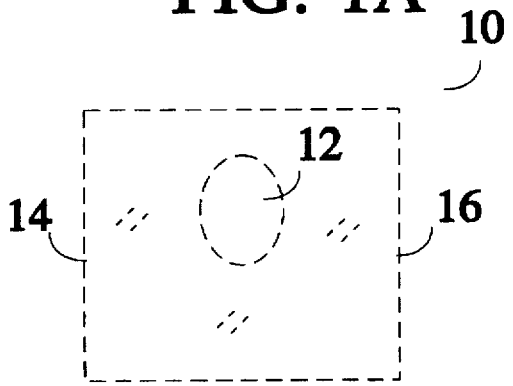
FIG. 1A is an illustration of a toilet seat cover which is in the form of a rectangularly shaped sheet.

FIG. 1A is an illustration of a toilet seat cover 10 which is in the form of a rectangularly shaped sheet. The toilet seat cover 10 is intentionally shown in dashed line form. The toilet seat cover 10 typically includes solid areas shown by shading and a substantially centrally located oval opening 12. The toilet seat cover 10 is preferably made from a single material such as a flexible plastic material from which plastic sandwich bags are often made. The material for the toilet seat cover 10 is preferably durable, non-porous, and lightweight. Durability prevents it from tearing easily, non-porousness prevents transmission of diseases, and the lightweight characteristic makes it easy to store, carry, and use.

Figure 1B:
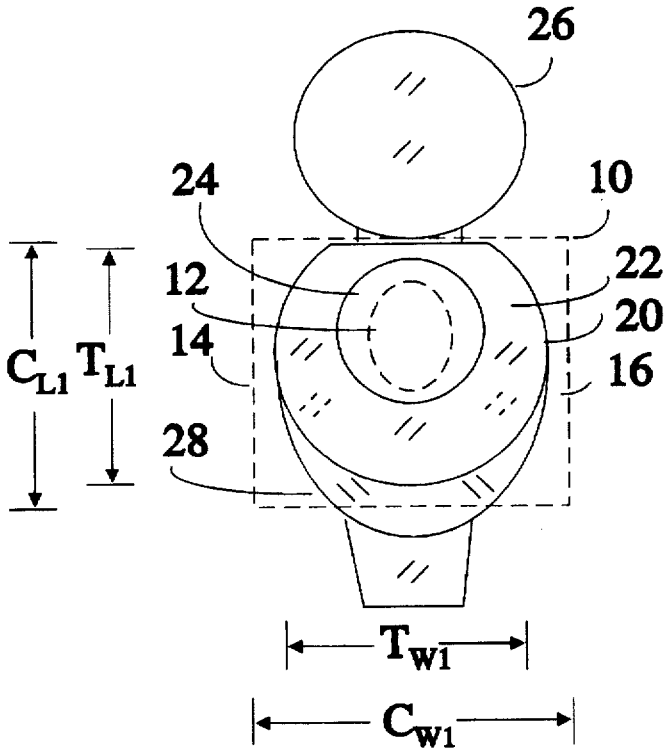
FIG. 1B is an illustration of the placement of the toilet seat cover of FIG. 1A over a toilet seat.

FIG. 1B shows the placement of the toilet seat cover 10 over the toilet seat 20. The toilet seat 20 has a top surface 22 and an opening 24. The toilet seat 20 rests on a bowl 28 and a lid 26 is attached to the bowl 28. Typically when the toilet seat cover 10 is placed over the toilet seat 20 as shown in FIG. 1B, the entire top surface 22 of the toilet seat 20 is covered. In addition, the opening 12 of the toilet seat cover 10 is placed over the opening 24 in the toilet seat 20. The toilet seat cover 10 has a width "$C_{W1}$", which is typically greater than the width "$T_{W1}$" of toilet seat 20, and a length $C_{L1}$, which is typically equal to or greater than the length "$T_{L1}$" of the toilet seat 20.

Figure 1C:
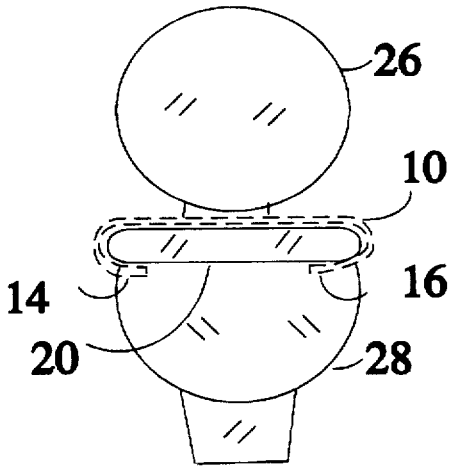
FIG. 1C is an illustration of the tucking of portions of the toilet seat cover of FIG. 1A under a toilet seat.

The toilet seat cover 10 may be folded up into a compact unit and stored in a dispenser. In operation, a user would unfold the toilet seat cover 10 and place it over the toilet seat 20 as shown in FIG. 1B. The user would then tuck portions of the seat cover 10 underneath the toilet seat 20, such as portions 14 and 16 shown tucked underneath the toilet seat 20 in FIG. 1C. This tucking step secures the toilet seat cover 10 and inhibits the toilet seat cover 10 from moving around.

Figure 2A:
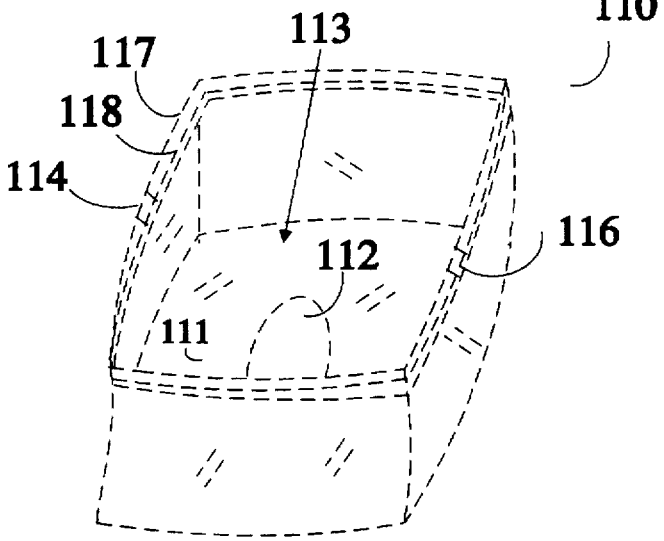
FIG. 2A is an illustration of a toilet seat cover which is in the form of a bag having a top opening and a bottom opening.

FIG. 2A is an illustration of a toilet seat cover 110 which is in the form of a bag. The toilet seat cover 110 is intentionally shown in dashed line form. The toilet seat cover 110 typically includes solid areas shown by shading, a large typically rectangular opening 113 at the top of the bag shape and a smaller oval opening 112 at the bottom of the bag shaped toilet seat cover 110. The oval opening 112 is typically substantially centrally located. The toilet seat cover 110 is preferably made from a material similar to that of FIG. 1A.

In contrast to the cover 10 of FIG. 1A The toilet seat cover 110 also includes an overlapping band or lip 117 preferably around a top peripheral portion of the bag shaped toilet seat cover 110. A cord 118 passes through the overlapping band 117. The overlapping band 117 effectively attaches the cord 118 to the toilet seat cover 110. Openings 114 and 116 are typically provided in the overlapping band 117, to allow a user to pull the cord 118 from two opposing sides.

Figure 2B:
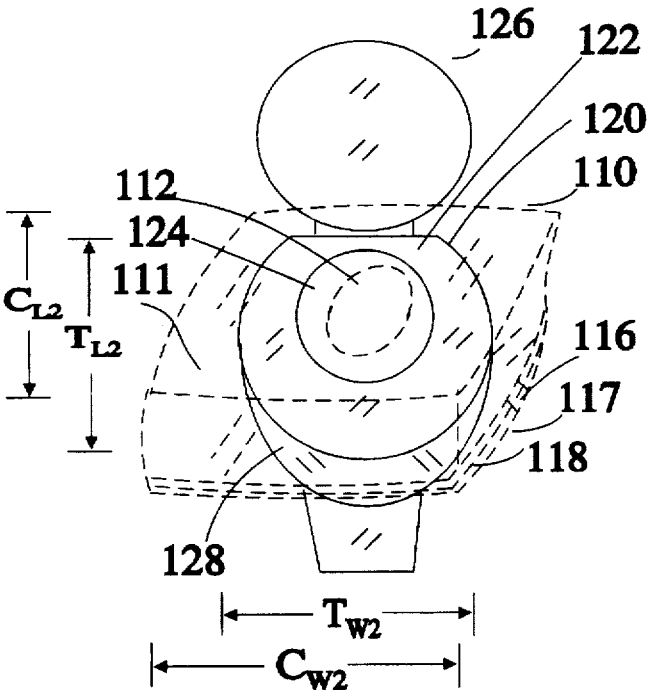
FIG. 2B is an illustration of the placement of the toilet seat cover of FIG. 2A over a toilet seat.

FIG. 2B shows the placement of the toilet seat cover 110 over the toilet seat 120. As in FIG. 1B, the toilet seat 120 has a top surface 122 and an opening, and the toilet seat 120 rests on a bowl 128, which has a lid 126 attached to it. Similarly, when the toilet seat cover 110 is turned upside down and then placed over the toilet seat 120 as shown in FIG. 2B, the entire top surface 122 of the toilet seat 120 is covered by the bottom surface 111 of the bag shaped toilet seat cover 110. In addition, the oval opening 112 of the toilet seat cover 110 is placed over the opening 124 in the toilet seat 120. The width of the bottom surface 111 of the toilet seat cover 110, which is "$C_{W2}$", is typically greater than the width "$T_{W2}$" of toilet seat 120, and the length of the bottom surface 111 of the toilet seat cover 110, $C_{L2}$, is typically at least as long or longer than the length "$T_{L2}$" of the toilet seat.

Figure 2C:
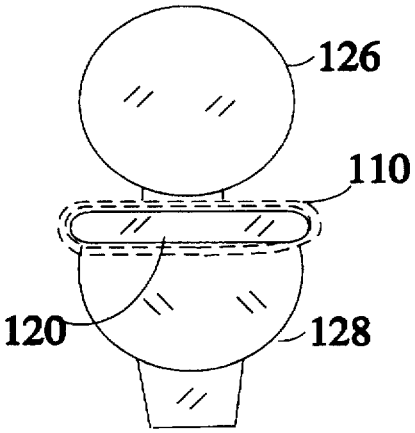
FIG. 2C is an illustration of the tightening of a portion of the toilet seat cover of FIG. 2A under a toilet seat.

In operation a user, inverts the bag shaped toilet seat cover 110, then places the toilet seat cover 110 over the toilet seat 120, lifts up the toilet seat 120, and then pulls cord 118 to tighten the bag shaped toilet seat cover 110 underneath the toilet seat 120. A user preferably pulls the cord 118 with two hands, one hand pulling the cord at opening 114 and one hand pulling the cord at opening 116. The pulling of the cord 118 tightens and secures the bag shaped toilet seat cover 110 under the toilet seat 120 as shown in FIG. 2C.

The cord 118 can be any material but is preferably an elastic material or a plastic material similar to the toilet seat cover 110. The toilet seat cover 10 or 110 may be made of a clear plastic material or a material such as used for sandwich bags.

We claim:

1. A method of covering a toilet seat comprising:

providing a toilet seat cover of a non-porous flexible material having a first opening; wherein the non-porous flexible material is substantially shaped in the form of a bag, having said first opening substantially near the bottom of the bag shape and a second opening substantially near the top of the bag shape;

wherein the sanitary cover is adapted to be a toilet seat cover and the first opening of the non-porous flexible material is slightly smaller than a toilet seat opening; and wherein an attachment device is provided at one or more locations around a peripheral portion of the bag shape at said second opening, and the sanitary cover further comprises a cord which passes through the attachment device;

inverting said bag shaped cover over a toilet seat such that said first opening will be aligned with said opening in said toilet seat, lifting said toilet seat from contact with a toilet bowl and pulling said cord to tighten said second opening underneath said toilet seat.

2. The sanitary cover of claim 1 wherein the cord is elastic.

3. The sanitary cover of claim 1 wherein the cord is flexible plastic.

4. The sanitary cover of claim 1 wherein the attachment device is comprised of one or more bands around the periphery of the bag shape.

5. A method of covering a toilet seat comprising:

providing a toilet seat cover constructed of a flexible material having a first opening, the flexible material shaped substantially in the form of a bag, having said first opening at the bottom of the bag and a second opening at the top of the bag;

wherein the sanitary cover is adapted to be a toilet seat cover and the first opening at the bottom of the bag is adapted to be smaller than a toilet seat opening and the second opening at the top of the bag is adapted to be larger than the width of a toilet seat so that the top of the bag can be inserted over a toilet seat and one or more substantially side portions of the sanitary cover can be tucked underneath the toilet seat;

where an attachment device is provided at one or more locations of the bag shape, and wherein the sanitary cover further comprises a cord which passes through the attachment device;

inverting said bag shaped cover over a toilet seat such that said first opening will be aligned with said opening in said toilet seat, lifting said toilet seat from contact with a toilet bowl and pulling said cord to tighten said second opening underneath said toilet seat.

* * * * *